US005381615A

United States Patent [19]

MacMillan

[11] Patent Number: 5,381,615

[45] Date of Patent: Jan. 17, 1995

[54] FOOTWEAR INCORPORATING A MULTIPLE-SWITCH LIGHTING CIRCUIT

[75] Inventor: M. Sean MacMillan, Los Angeles, Calif.

[73] Assignee: Angel-Etts f California, Inc., Los Angeles, Calif.

[21] Appl. No.: 175,132

[22] Filed: Dec. 29, 1993

[51] Int. Cl.[6] ..... A43B 23/00; F21C 15/08

[52] U.S. Cl. ..... 36/137; 362/103

[58] Field of Search ..... 36/137; 362/103

[56] References Cited

U.S. PATENT DOCUMENTS

| | | | |
|---|---|---|---|
| 1,933,243 | 10/1933 | DeMerolis et al. | 36/137 X |
| 2,632,093 | 3/1953 | DeMerolis et al. | 36/137 X |
| 2,941,315 | 6/1960 | Irving et al. | 36/137 X |
| 2,976,622 | 3/1961 | Shearouse | 36/137 X |
| 3,008,038 | 11/1961 | Dickons et al. | 36/137 X |
| 3,070,907 | 1/1963 | Rocco | 36/137 X |
| 3,800,133 | 3/1974 | Duval | 36/137 X |
| 3,866,035 | 2/1975 | Richey, Jr. | 362/104 |
| 3,893,247 | 7/1975 | Dana, III | 36/137 X |
| 3,946,505 | 3/1976 | Dana, III | 362/103 X |
| 4,014,115 | 3/1977 | Reichert | 36/137 |
| 4,020,572 | 5/1977 | Chiaramonte, Jr. | 36/137 |
| 4,076,976 | 2/1978 | Fenton | 362/104 |
| 4,112,601 | 9/1978 | Chiaramonte, Jr. | 36/137 |
| 4,128,861 | 12/1978 | Pelengaris | 362/103 |
| 4,130,951 | 12/1978 | Powell | 36/137 |
| 4,158,922 | 6/1979 | Dana, III | 36/137 |
| 4,164,008 | 8/1979 | Miller et al. | 362/103 |
| 4,254,451 | 3/1981 | Cochran, Jr. | 362/103 |
| 4,264,845 | 4/1981 | Bednarz | 362/104 X |
| 4,308,572 | 12/1981 | Davidson et al. | 362/103 |
| 4,324,054 | 4/1982 | Rovinsky | 36/137 |
| 4,350,853 | 9/1982 | Ganyard | 200/52 R |
| 4,367,515 | 1/1983 | Beard | 362/103 |
| 4,383,244 | 5/1983 | Knauff | 340/321 |
| 4,412,205 | 10/1983 | Von Kemenczky | 340/331 |
| 4,453,052 | 6/1984 | Semian et al. | 200/85 R |
| 4,463,412 | 7/1984 | Broach | 362/103 X |
| 4,602,191 | 7/1986 | Davila | 362/103 X |
| 4,774,434 | 9/1988 | Bennion | 313/500 |
| 4,848,009 | 7/1989 | Rodgers | 36/137 |
| 4,903,176 | 2/1990 | Chen | 362/103 |
| 4,997,196 | 3/1991 | Wood | 362/61 X |
| 5,033,212 | 7/1991 | Evanyk | 36/137 |
| 5,052,131 | 10/1991 | Rondini | 36/137 |
| 5,113,325 | 5/1992 | Eisenbraun | 362/103 |
| 5,128,843 | 7/1992 | Guritz | 362/103 |
| 5,143,439 | 9/1992 | Lewis et al. | 362/103 |
| 5,167,082 | 12/1992 | Chen | 36/2.6 |
| 5,188,447 | 2/1993 | Chiang et al. | 362/103 |
| 5,235,761 | 8/1993 | Chang | 36/137 X |
| 5,237,760 | 8/1993 | Altman et al. | 36/137 |

FOREIGN PATENT DOCUMENTS

| | | | |
|---|---|---|---|
| 1253832 | 5/1989 | Canada . | |
| 0121026 | 10/1984 | European Pat. Off. | 36/137 |
| 2227714 | 11/1974 | France . | |
| 2675025 | 10/1992 | France . | |
| 483210 | 9/1937 | United Kingdom . | |
| WO/93/116-81 | 6/1993 | WIPO . | |

*Primary Examiner*—Paul T. Sewell
*Assistant Examiner*—BethAnne C. Cicconi
*Attorney, Agent, or Firm*—David M. Klein; Bryan Cave

[57] ABSTRACT

An improved article of footwear which incorporates a lighting circuit is disclosed. The article of footwear includes: a visible lighting element (4), a power source (2) connected to the lighting element (4), and at least a pair of pressure responsive switches (S1, S2) for controlling the supply of power (2) to the lighting element (4) through a condition responsive logic circuit (6). The article of footwear is preferably a shoe, and the lighting elements (4) are preferably LEDs. The logic circuit (6) is preferably an Exclusive-OR gate. Various switch, lighting and circuit configurations are disclosed.

8 Claims, 2 Drawing Sheets

FOOTWEAR INCORPORATING A MULTIPLE-SWITCH LIGHTING CIRCUIT

BACKGROUND OF THE INVENTION

1. Field of the Invention

The present invention relates generally to footwear incorporating lighting circuitry, and more particularly to an article of footwear incorporating a multiple-switch controlled lighting circuit for improving battery life.

2. Description of the Prior Art

Footwear incorporating lighting elements is well known in the art. The simplest such devices, as exemplified by U.S. Pat. Nos. 3,893,247 and 3,946,505, disclose shoes having lighting elements disposed in the heel and/or sole. The battery and lighting circuitry are disposed in a removable heel. A manual switch is provided for turning the lighting element on and off. A tilt switch is also provided for turning the light on and off responsive to the position of the shoe. Unfortunately, this tilt switch can become a disadvantage if the shoe is accidentally stored in a tilted position which could cause the battery to drain and prematurely discharge.

U.S. Pat. No. 4,158,922 discloses a shoe having a single lighting element incorporated in the heel. An oscillator is provided for causing continuous periodic flashing of the single light. A mechanical switch and/or a tilt switch may be included for activating the oscillating circuit.

In such prior art devices, the lighting element is turned on either manually or by a mercury switch. If the switch is left on, or the shoe is left at the wrong orientation, the light continues to operate draining power from the battery which prematurely discharges.

In an effort to overcome this problem with the prior art, U.S. Pat. No. 4,848,009, discloses an article of footwear provided with a battery, a light source, a motion responsive switch to intermittently connect the battery to the light source, and a timing circuit which is provided for extinguishing the light after a predetermined amount of time. However, such a timing circuit can unduly complicate the design and, moreover, can prematurely extinguish the light before the total desired effect is obtained by the wearer.

The disadvantages of the prior art are overcome by the present invention which extends the battery life in such footwear without the need for a timing circuit and which permits the wearer to dynamically control the operation of the lights depending on the movement of the foot while preventing inadvertent discharge of the battery regardless of the orientation in which the shoe is left when not being worn.

SUMMARY OF THE INVENTION

The present invention is an improved article of footwear having a heel and toe which comprises at least one lighting element mounted on the footwear and visible from the exterior of the footwear when illuminated; and a source of power connected to the lighting element for supplying power thereto for illuminating the lighting element; wherein the improvement comprises a plurality of movement responsive switches such as pressure responsive switches, disposed on the sole of the footwear, the plurality of switches comprising at least a first switch disposed on the sole toward a toe end of the footwear and at least a second switch disposed on the sole toward a heel end of the footwear, each switch having an on condition and an off condition, the switches being positioned on the sole of the footwear, for attaining the on or off condition in response to movements such as pressure inducing movements as the wearer moves the foot; and a condition responsive logic circuit operatively connected between the plurality of switches, the source of power, and the lighting element, the plurality of switches providing a plurality of different sets of input conditions to the logic circuit dependent on the condition of each of the switches, the logic circuit having a different output condition dependent on the input condition, the logic circuit providing a first output condition for illuminating the lighting element in response to a first input condition of the switches when at least said first and second switches are not in the same condition, the logic circuit providing a second output condition for preventing the illumination of the lighting element when at least the first and second switches are in the same condition; whereby the illumination of the lighting element is prevented when at least when the foot is at rest in the footwear and when no foot is present in the footwear and illuminated when the footwear is being worn and the pressure is either on the heel or the toe.

Thus, the present invention provides an article of footwear which incorporates a lighting circuit and which improves battery life without the necessity for a timing circuit.

The article of footwear is preferably a shoe, and the lighting elements are preferably LEDs, although other conventional lighting devices may be employed. The switches are preferably conventional pressure activated switches and arranged with a logic circuit such as, preferably, an Exclusive-Or gate if only two such switches are employed, so that the lighting element is turned on, in such a two switch arrangement, only if just one of the two pressure switches is activated in response to a pressure inducing movement of the heel or toe against a surface. For different lighting effects, the switches may be arranged in a variety of different circuit configurations and, if desired, more than two switches may be employed with appropriate changes to the condition responsive logic to produce the desired lighting effects.

DESCRIPTION OF THE PREFERRED EMBODIMENT

Figure 3:
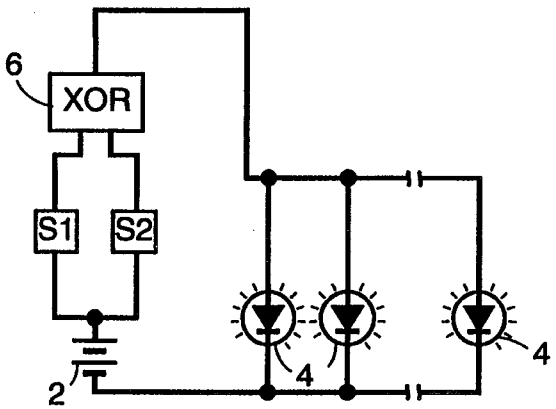
FIG. 3 is a circuit diagram of the embodiment of the invention shown in FIGS. 1 and 2.
Figure 1:
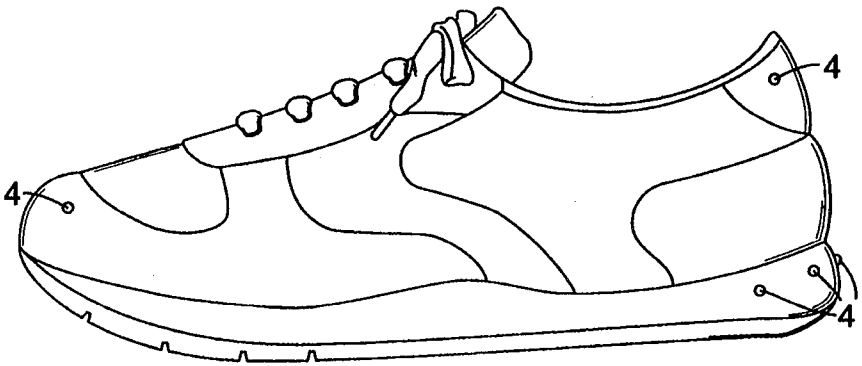
FIG. 1 is a side view of an article of footwear, namely a shoe, incorporating the lighting circuitry of the present invention.
Figure 2:
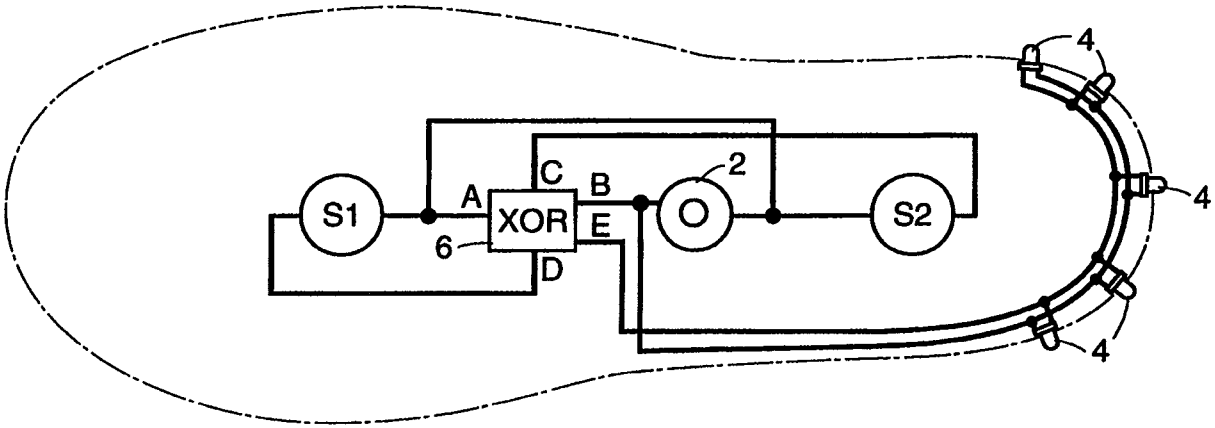
FIG. 2 is a cross-sectional bottom view of the shoe of FIG. 1 incorporating the lighting circuitry of the present invention.

As shown in FIGS. 1–3, the present invention is an article of footwear, preferably a shoe, which incorporates a lighting circuit. A battery 2 is the source of power for operating the electrical lighting circuit. Lighting elements 4, which are preferably light emitting diodes (LEDs), although other light sources may be employed, are preferably disposed around the periphery of the shoe. In the presently preferred embodiment, the LEDs 4 are preferably fixedly secured inside the sole of the shoe and are visible from the exterior of the shoe when lit by shining through an opening in the sole of the shoe or through a transparent or semi-transparent cover on the shoe. However, if desired, such an arrangement can be removably attached to the shoe or disposed in some other fashion on the shoe. Of course, the lighting elements 4 may be disposed in any desired positions on the shoe depending upon the desired novelty or aesthetic effect desired.

In the presently preferred embodiment, a pair of conventional pressure activated switches S1 and S2 are connected between the battery 2 and the lighting elements or LEDs 4 for completing the electrical circuit to the lighting elements 4. Pressure switches S1 and S2 are preferably any of numerous conventional types known in the art, such as shown, by way of example, in U.S. Pat. Nos. 3,800,133, or 4,453,052. In such a conventional pressure switch S1, S2, when a predetermined amount of pressure is applied to the switch S1, S2, a circuit is closed through the switch S1, S2. The pressure threshold for closing the switches S1 and S2 may be adjusted for the type and size of shoe, if desired. If desired, other types of switches may be employed as long as they are consistent with the purpose and function of the presently preferred pressure switches S1, S2.

In the presently preferred embodiment, a condition responsive logic circuit, which is preferably an Exclusive-OR (XOR) gate 6 in the instance when two switches S1, S2 are employed, is connected between the pressure switch S1 and S2 outputs and the lighting elements 4 for controlling the operation of the lighting elements 4 based on the conditions of the switches S1, S2. As shown and preferred, Exclusive-OR gate 6 is powered by the battery 2 via lines A and B. Lines C and D to Exclusive-OR gate 6 are inputs from the pressure switches S1 and S2 which provide the input conditions to the condition responsive logic circuit 6. Output line E, which is connected to the lighting elements or LEDs 4, provides a different set of output conditions dependent on the set of input conditions provided to the condition responsive logic circuit 6. In the presently preferred embodiment, if the shoe wearer is standing upright with his or her weight substantially evenly distributed on the sole of the shoe, both pressure switches S1 and S2 will be in the closed position, thereby providing a set of input conditions to the Exclusive-OR gate 6 which causes the lighting elements 4 to be extinguished or off. Similarly, if only one of the front or rear pressure switch S1 or S2 is in the closed position, then a set of input conditions would be provided to the Exclusive-OR gate 6 indicating that one switch is open and the other closed which causes the lighting elements or LEDs 4 to be illuminated. Thus, if the wearer is walking or running, which causes pressure to alternate on a switch or between the front and rear of the shoe thereby closing only one of the switches S1 or S2 at a time, the lighting elements 4 will illuminate each time pressure is applied on the heel or toe sole of the shoe. When the wearer comes to rest with the foot flat on the ground, pressure is applied substantially evenly on both the sole and heel together, or when there is no pressure applied to either switch, such as when the shoe is not being worn, the switches S1, S2 provide a set of input conditions to the condition responsive logic circuit 6 which results in an output condition of the condition responsive logic circuit 6 which causes lighting element 4 to be extinguished or off. Of course, the conventional pressure activated switches S1, S2, preferably have their respective threshold levels conventionally adjusted so that there is insufficient pressure on the switches S1, S2 to activate them when they are not being worn, such as by setting a threshold level associated with the minimum weight expected of a wearer of the footwear. Thus, when the shoe is not being worn, no power will be used by the LEDs 4 regardless of the storage orientation of the shoe.

If more than two switches are desired, the condition responsive logic circuit 6 may be modified to compensate for additional switch inputs which create a different set of input conditions which may be arranged in accordance with conventional Boolean Algebra to provide a similar set of output conditions to those discussed above. For example, the, benefits of the present invention may be obtained using a condition responsive logic circuit 6 comprising a NOR gate and a parallel AND gate which receive as inputs the output of each of the switches. The output of the NOR and AND gates are then fed as inputs to a NAND gate with the output of the NAND gate controlling the illumination of the lighting elements 4. Again, as in the presently preferred embodiment employing only two switches S1, S2 and an Exclusive-OR gate 6, the lighting elements 4 are illuminated unless all of the switches are in the closed position or all of the switches are in the open position.

Figure 6:
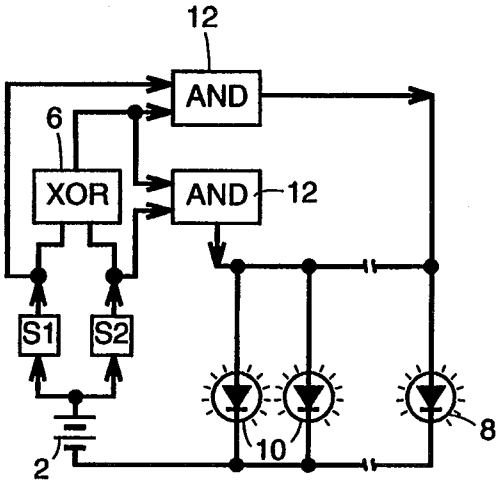
FIG. 6 is a circuit diagram of the alternative embodiment of the invention shown in FIGS. 4 and 5.
Figure 4:
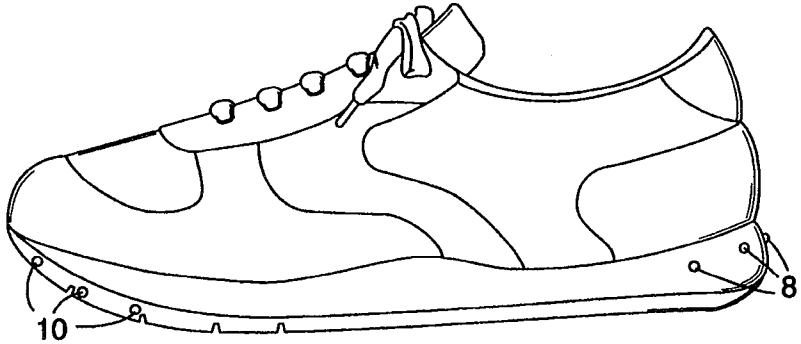
FIG. 4 is a side view of the shoe of FIG. 1 incorporating an alterative embodiment of the lighting circuitry of the present invention.
Figure 5:
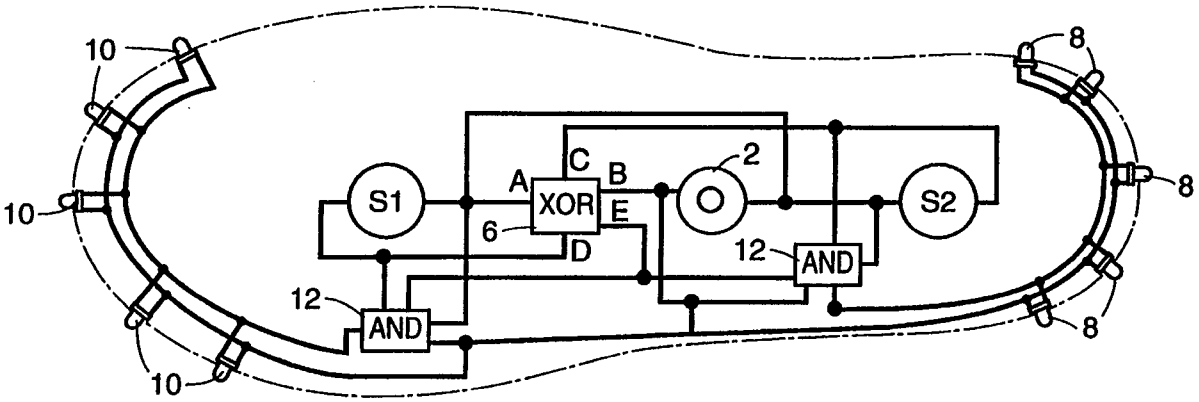
FIG. 5 is a cross-sectional bottom view of the shoe of FIG. 4 incorporating the alterative embodiment of the lighting circuitry of FIG. 4.

As shown in FIGS. 4–6, if desired, the above-described power saving circuit may be combined with other circuitry for providing different lighting effects. In the alternative embodiment shown, by way of example in FIGS. 4–6, two electrically isolated sets of LEDs 8, 10 are provided, with on set of LEDs 8 being located toward the rear of the shoe, and with the other set of LEDs 10 being located toward the front of the shoe. In this instance, a pair of AND gates 12 are preferably provided in the circuit, with a first AND gate 12 controlling the front set of LEDs 10 and a second AND gate 12 controlling the rear set of LEDs 8. In this embodiment, the front LEDs 10 will be illuminated if only the front switch S1 is on, and the rear LEDs 8 will be illuminated if only the rear switch S2 is on.

If more than two switches are used, as discussed above, the condition responsive logic 6, in addition to the AND gate discussed, may include another AND gate for each lighting element and its corresponding switch, in which instances each switch would then be connected to its associated AND gate for providing an input condition thereto. The output of the previously mentioned NAND gate, in this example, would also be connected for providing an input condition to each AND gate. Thus, each lighting element would be illuminated only if its switch is in the on condition and all of the switches are not in either the on or off condition.

Although the present invention has been described in detail with respect to certain embodiments and examples, variations and modifications exist which are within the scope of the present invention as defined in the following claims, such as, for example, combining the above condition responsive circuit with a mechanism for also sequencing the operation of the lights.

What is claimed is:

1. An improved article of footwear comprising:

a sole having a heel end and toe end; at least one lighting element mounted on the footwear and visible from the exterior of the footwear when illuminated; and a source of power connected to the at least one lighting element for supplying power thereto for illuminating the at least one lighting element;

wherein the improvement comprises:

a plurality of pressure responsive switches disposed on the sole of the footwear, the plurality of switches comprising at least one switch disposed on the sole toward a toe end of the footwear and at least a second switch disposed on the sole toward a heel end of the footwear, each switch having an on condition and an off condition, the switches being positioned on the footwear for attaining the on or off condition in response to pressure applied to the footwear by the wearer; and a condition responsive logic circuit operatively connected between the plurality of switches, the source of power, and the at least one lighting element, the plurality of switches providing a plurality of different sets of input conditions to the logic circuit dependent on the condition of each of the switches, the login circuit having a different output condition dependent on the input condition, the logic circuit providing a first output condition for illuminating the at least one lighting element in response to a first input condition of the switches when at least the first and second switches are not in the same condition, the logic circuit providing a second output condition for preventing the illumination of the at least one lighting element when at least the first and second switches are in the same condition; wherein the logic circuit prevents illumination of the at least one lighting element at least when the footwear is at rest and the footwear is illuminated when the motion of the wearer of the at least one lighting element is moving between heel and toe.

2. An improved article of footwear according to claim 1 wherein the logic circuit comprises an Exclusive-OR gate, one switch connected to the Exclusive-OR gate as a first condition providing input, and at least the other switch connected to the Exclusive-0R gate as a second condition providing input, an output of the Exclusive-OR gate comprising the output condition for controlling the illumination of the at least one lighting element;

the logic circuit providing the first output condition for illuminating the at least one lighting element only when one of the first and second switches is in an on condition, the logic circuit providing the second output condition if both of the switches are in an on condition or if both of the switches are in an on off condition; whereby the lighting element is extinguished if either of the input conditions provide the second output condition.

3. An improved article of footwear according to claim 2 wherein the lighting element comprises a plurality of electrically connected lighting elements.

4. An improved article of footwear according to claim 1 wherein the switches are positioned on the sole of the footwear for attaining the on or off condition in response to pressure inducing movements of the sole of the footwear against the surface as the wearer moves the foot.

5. An improved article of footwear according to claim 2 wherein the switches are positioned on the sole of the footwear for attaining the on or off condition in response to pressure inducing movements of the sole of the footwear against the surface as the wearer moves the foot.

6. An improved article of footwear according to claim 1 wherein the at least one lighting element comprises at least one lighting element disposed on a periphery of the sole of the footwear.

7. An improved article of footwear according to claim 1 wherein the at least one lighting element comprises at least one lighting element disposed on a upper portion of the footwear.

8. An improved article of footwear according to claim 2 wherein the at least one lighting element comprises a first lighting element and a second lighting element electrically isolated from the first lighting element, each lighting element mounted on the footwear and visible from the exterior of the footwear when illuminated;

and wherein the logic circuit further comprises an AND gate associated with each lighting element, the output condition of each AND gate controlling the illumination and extinguishing of its associated lighting element;

each one of the switches also being associated with one of the lighting elements and its corresponding AND gate, each switch being connected to its associated AND gate for providing an input condition thereto, the output of the Exclusive-OR gate also being connected to each AND gate for providing an input condition thereto, wherein each lighting element is illuminated only if the only switch in the on position is the switch associated with that lighting element.

* * * * *

UNITED STATES PATENT AND TRADEMARK OFFICE

CERTIFICATE OF CORRECTION

PATENT NO. : 5,381,615

DATED : January 17, 1995

INVENTOR(S): M. Sean McMillan

It is certified that error appears in the above-identified patent and that said Letters Patent is hereby corrected as shown below:

On the title page, item:

[75] Inventor: M. Sean McMillan, Los Angeles, Calif.

[73] Assignee: Angel-Etts of California, Inc. Los Angeles, Calif.

| Column | Line | Delete | Insert |
|---|---|---|---|
| 5 | 37 | "footware" (second occurrence) | --at least one lighting element-- |
| 5 | 38 | "at least one lighting element" | --footware-- |
| 6 | 3 | | --at least one-- after "the" |
| 6 | 7 | | --at least one-- after "the" |

Signed and Sealed this

Thirtieth Day of May, 1995

Attest:

Bruce Lehman

BRUCE LEHMAN

Attesting Officer

Commissioner of Patents and Trademarks